US005174914A

United States Patent [19]

Gutzmann

[11] Patent Number: 5,174,914

[45] Date of Patent: Dec. 29, 1992

[54] CONVEYOR LUBRICANT COMPOSITION HAVING SUPERIOR COMPATIBILITY WITH SYNTHETIC PLASTIC CONTAINERS

[75] Inventor: Timothy A. Gutzmann, Eagan, Minn.

[73] Assignee: Ecolab Inc., St. Paul, Minn.

[21] Appl. No.: 642,065

[22] Filed: Jan. 16, 1991

[51] Int. Cl.[5] ..... C10M 173/020

[52] U.S. Cl. ..... 252/34; 252/49.3

[58] Field of Search ..... 252/49.3, 34

[56] References Cited

U.S. PATENT DOCUMENTS

| | | | |
|---|---|---|---|
| Re. 30,885 | 3/1982 | Rieder . | |
| 3,148,747 | 9/1964 | Batchelor . | |
| 3,170,539 | 2/1965 | Snay et al. . | |
| 3,336,225 | 8/1967 | Sayad et al. . | |
| 3,576,234 | 4/1971 | Batchelor . | |
| 3,583,914 | 6/1971 | Garvin et al. | 252/34.7 |
| 3,661,784 | 5/1972 | Bellos | 252/49.3 |
| 3,766,068 | 10/1973 | Tesdahl et al. . | |
| 3,860,521 | 1/1975 | Aepli et al. . | |
| 4,226,325 | 10/1980 | Vandas . | |
| 4,233,176 | 11/1980 | Conner, Sr. . | |
| 4,342,596 | 8/1982 | Conner, Sr. . | |
| 4,626,367 | 12/1986 | Kuwamoto et al. . | |
| 4,719,084 | 1/1988 | Schmid | 252/34 |
| 4,752,405 | 6/1988 | Kyle | 252/49.3 |
| 4,824,586 | 4/1989 | Johnson et al. . | |
| 4,828,735 | 5/1989 | Minagawa et al. . | |
| 4,828,737 | 5/1989 | Sandberg et al. . | |
| 4,839,067 | 6/1989 | Jansen | 252/11 |
| 4,895,668 | 1/1990 | Singh et al. | 252/34 |
| 4,929,375 | 5/1990 | Rossio et al. | 252/49.3 |
| 5,009,801 | 4/1991 | Wider | 252/49.3 |
| 5,062,978 | 11/1991 | Weber et al. | 252/49.3 |
| 5,062,979 | 11/1991 | Scharf | 252/49.3 |
| 5,073,280 | 12/1991 | Rossio | 252/49.3 |

FOREIGN PATENT DOCUMENTS

| | | |
|---|---|---|
| 50919/90 | 9/1990 | Australia . |
| 70188/91 | 8/1991 | Australia . |
| 0044458 | 1/1982 | European Pat. Off. . |
| 0233774 | 8/1987 | European Pat. Off. . |
| 0260508 | 3/1988 | European Pat. Off. . |
| 0310363 | 4/1989 | European Pat. Off. . |
| 0372628 | 6/1990 | European Pat. Off. . |
| 0384282 | 8/1990 | European Pat. Off. . |
| 0445525A1 | 9/1991 | European Pat. Off. . |
| 1644913 | 1/1971 | Fed. Rep. of Germany . |
| 2-55794 | 2/1990 | Japan . |
| WO90/10053 | 9/1990 | PCT Int'l Appl. . |

OTHER PUBLICATIONS

*The Merck Index*, Eleventh Edition, 1989, p. 2095.

*Disinfection, Sterilization, and Preservation*, Fourth Edition, Seymour S. Block, 1991, pp. 228, 248, 249, 274, 275.

*Inhibition and Destruction of the Microbial Cell*, Ed. W. B. Hugo, pp. 636–639, 675 and 685.

*Deutsche Medizinische Wochenschrift*, 1935, V. 61, pp. 829–832.

*Recent Developments in the Technology of Surfactants*, Critical Reports on Applied Chemistry, vol. 30, 1990, pp. 65–73.

*Chlorhexidine*, Chapter 16, G. W. Denton, pp. 274–275.

Akzo Chemie America Bulletin 85-1, Specifications and Properties of DUOMEEN® Diamines and Diamine Salts DUOMAC® Diamine Acetate Salts, pp. 1–6.

*Primary Examiner*—Jack Cooper

*Assistant Examiner*—Thomas Steinberg

*Attorney, Agent, or Firm*—Merchant, Gould, Smith, Edell, Welter & Schmidt P.A.

[57] ABSTRACT

Concentrated liquid and solid lubricating compositions having superior compatability with synthetic polymeric packaging materials, such as polyethylene terephthalate (PET), linear high density polyethylene (LHDPE), polystyrene, polymeric coated papers, and the like, can include 1 to 50 wt % of a fatty acid diamine salt having the formula $[(R^1)(R^2)N(R^5)NH(R^3)(R^4)]^+(R^6COO)^-$ or $[(R^1)(R^2)NH(R^5)NH(R^3)(R^4)]^{++}$ $(R^6COO)_2^-$ wherein $R^1$ is a $C_{10-18}$ aliphatic group; $R^2$, $R^3$, and $R^4$ are independently hydrogen or an alkoxy group containing one to five alkylene oxide units; $R^5$ is a $C_{1-5}$ alkylene group; and $R^6$ is a $C_{10-18}$ aliphatic group. The lubricating compositions are particularly useful on the load bearing surfaces of conveyor belts used in the bottling of carbonated beverages in polyethylene terephthalate bottles.

26 Claims, No Drawings

CONVEYOR LUBRICANT COMPOSITION HAVING SUPERIOR COMPATIBILITY WITH SYNTHETIC PLASTIC CONTAINERS

FIELD OF THE INVENTION

Broadly, the invention relates to aqueous lubricant compositions and more particularly to a lubricant compositions compatible with synthetic polymeric packaging materials, such as polyethylene terephthalate (PET), linear high density polyethylene (LHDPE), polystyrene, and the like. Such lubricant compositions are adapted for use as a lubricating agent on the load bearing surfaces of a chain driven conveyor system used for conveying such synthetic polymeric materials. More specifically, the invention relates to a lubricant compositions specifically adapted for use in lubricating the load bearing surface of a conveyor system used in the bottling of carbonated beverages in polyethylene terephthalate bottles.

BACKGROUND OF THE INVENTION

Beverages and other comestibles are often processed and packaged in synthetic polymeric packaging on mechanized conveyor systems which are lubricated to reduce friction between the packaging and the load bearing surface of the conveyor. The lubricants commonly used on the load bearing surfaces of these conveyor systems, such as those used in the food processing, beverage and the brewery industries, typically contain fatty acid soaps as the active lubricating ingredient because of the superior lubricity provided by fatty acid soaps.

The fatty acid soaps are generally formed by neutralizing a fatty acid with a caustic compound such as alkali metal hydroxide (NaOH or KOH) or an alkanolamine (MEA, DEA or TEA). Fatty acid soaps neutralized with such caustic compounds are generally incompatible with polyethylene terephthalate to such an extent that prolonged contact frequently results in the formation of stress cracks and fissures in the plastic. This is most frequently observed in bottling plants where carbonated beverages are placed into polyethylene terephthalate bottles because of the stress placed upon the bottle by the bottling process, the carbonated beverage contained within the bottle, and interval pressure.

Various polyethylene terephthalate compatible lubricant compositions have been developed by replacing at least a portion of the fatty acid with other lubricating components. For example, Rossio, U.S. Pat. No. 4,929,375, suggests that incorporation of a tertiary amine, such as a ($C_{8-10}$) alkyl dimethyl amine, into a fatty acid lubricant composition enhances the polyethylene terephthalate compatibility of the lubricant composition.

While these various attempts have been successful in producing lubricant compositions which are compatible with polyethylene terephthalate, such compositions have not generally been effective for providing both superior lubricity and superior compatibility with synthetic polymeric packaging materials. Accordingly, a substantial need still exists for a conveyor lubricant which provides a combination of superior lubricity and compatibility with synthetic polymeric packaging materials.

SUMMARY OF THE INVENTION

The invention resides in an aqueous lubricant composition capable of providing superior lubricity to the interface between the load bearing surface of a conveyor system and a synthetic polymeric packaging material and a related method for effecting such lubrication. The lubricant composition may be formed as a liquid or solid concentrate and includes an effective lubricating amount of a fatty acid diamine salt having the formula $$[(R^1)(R^2)N(R^5)NH(R^3)(R^4)]^+(R^6COO)^- \text{ or}$$

$$[(R^1)(R^2)NH(R^5)NH(R^3)(R^4)]^{++}(R^6COO)_2^-$$

wherein $R^1$ is a $C_{10-18}$ aliphatic group; $R^2$, $R^3$, and $R^4$ are independently hydrogen or an alkoxy group containing one to five alkylene oxide units; $R^5$ is a $C_{1-5}$ alkylene group; and $R^6$ is a $C_{10-18}$ aliphatic group. The lubricant composition further includes one or more of (i) an amount of a hydrotrope effective for providing sufficient aqueous solubility to the fatty acid and diamine components of the fatty acid diamine salt so as to permit formation of the fatty acid diamine salt, (ii) an effective cleansing amount of an anionic or nonionic surfactant, and (iii) an effective chelating amount of a chelating agent. The liquid form of the lubricant composition includes a major proportion of water while the solid form of the lubricant composition includes an amount of a solidification agent effective for assisting in solidification of the composition.

DETAILED DESCRIPTION OF THE INVENTION

The invention resides in an improved lubricant concentrate composition that can be formulated in liquid or solid form. The lubricant composition comprises (-) a fatty acid diamine salt having the formula $$[(R^1)(R^2)N(R^5)NH(R^3)(R^4)]^+(R^6COO)^- \text{ or}$$

$$[(R^1)(R^2)NH(R^5)NH(R^3)(R^4)]^{++}(R^6COO)_2^-$$

wherein $R^1$ is a $C_{10-18}$ aliphatic group; $R^2$, $R^3$, and $R^4$ are independently hydrogen or an alkoxy (preferably ethoxy) group containing one to five alkylene oxide (preferably ethylene oxide) units; $R^5$ is a $C_{1-5}$ alkylene group; and $R^6$ is a $C_{10-18}$ aliphatic group, (-) a hydrotrope effective for providing sufficient aqueous solubility to the fatty acid and diamine components of the fatty acid diamine salt so as to permit formation of the fatty acid diamine salt, (-) an anionic or nonionic surfactant effective for cleaning the lubricated surface, and (-) a chelating agent. The liquid form of the lubricant composition further includes a major proportion of water while the solid form of the lubricant composition further includes an amount of a solidification agent effective for assisting in solidification of the composition.

The lubricant composition may also include various optional components intended to enhance lubricity, microbial efficacy, physical and/or chemical stability, etc. The lubricant composition of the invention is particularly well suited for lubricating the load bearing surfaces and drive chains of conveyor systems used to convey polyethylene terephthalate bottles filled with a carbonated beverage.

Fatty Acid Diamine Salt

We have surprisingly discovered that an aqueous solution of selected fatty acid diamine salts obtained as the neutralization product of a fatty acid and a diamine performs as an effective polyethylene terephthalate compatible lubricant composition capable of providing effective lubricating properties to the load bearing surface of a conveyor system. Useful fatty acid diamine salts are those having the general formula:

$$[(R^1)(R^2)N(R^5)NH(R^3)(R^4)]^+(R^6COO)^-$$

$$[(R^1)(R^2)NH(R^5)NH(R^3)(R^4)]^{++}(R^6COO)_2^-$$

wherein:

(-) $R^1$ is a $C_{10-18}$ aliphatic group, (-) $R^2$, $R^3$, and $R^4$ are independently hydrogen or an alkoxy group containing one to five alkylene oxide units, (-) $R^5$ is a $C_{1-5}$ alkylene group, and (-) $R^6$ is a $C_{10-18}$ aliphatic group.

For reasons of performance the preferred fatty acid diamine salts are those wherein $R^1$ is a $C_{10-18}$ aliphatic group derived from a fatty acid; $R^4$ is hydrogen; $R^5$ is a $C_{2-5}$ alkylene group; and $R^6$ is a $C_{10-18}$ aliphatic group.

For reasons of availability and performance the most preferred fatty acid diamine salts are those wherein $R^1$ is a $C_{10-18}$ aliphatic group derived from a fatty acid; $R^2$, $R^3$, and $R^4$ are hydrogen; $R^5$ is a propylene group; and $R^6$ is a $C_{10-18}$ aliphatic group.

The fatty acid diamine salts may be conveniently produced by reacting a suitable diamine of the formula $(R^1)(R^2)N(R^5)N(R^3)(R^4)$ with a suitable fatty acid of the formula $R^6COOH$ under conditions sufficient to produce the fatty acid diamine salt. Generally, such fatty acids will spontaneously neutralize such diamines to form the fatty acid diamine salts under ambient conditions provided both components can be brought into intimate contact such as through mutual solubilization.

The fatty acid diamine salt in liquid concentrates can be formed in solution by adding the hydrotrope to the water and then sequentially adding the fatty acid and the diamine. The fatty acid and diamine will react spontaneously to form the fatty acid diamine salt. The remaining formula components such as surfactant(s), sequestrant(s), alcohol(s) and other components can then be added and mixed into the formulation to complete the concentrate.

The fatty acid diamine salt in solid concentrates can be formed by (i) combining the hydrotrope, surfactant(s), sequestrant(s), and alcohol(s) to form a liquid premix, (ii) adding the fatty acid(s) to the premix to form a first mixture, (iii) heating the first mixture to a temperature above the melting point of the solidifying agent, (iv) sequentially adding the solidifying agent and the diamine to the heated first mixture under constant agitation to form a second mixture, (v) allowing the fatty acid and the diamine to spontaneously react in the second mixture to form a fatty acid diamine salt, and (vi) allowing the second mixture to solidify into a water soluble block of lubricant by cessation of agitation and cooling to ambient temperatures.

Diamines

Useful diamines are those having the general formula:

$$(R^1)(R^2)N(R^5)N(R^3)(R^4)$$

wherein:

(-) $R^1$ is a $C_{10-18}$ aliphatic group, preferably derived from a $C_{10-18}$ fatty acid, (-) $R^2$, $R^3$, and $R^4$ are independently hydrogen or an alkoxy group containing one to five alkylene oxide units, preferably hydrogen, and (-) $R^5$ is a $C_{1-5}$ alkylene group, preferably a propylene group.

Representative examples of useful diamines include N-coco-1,3-propylene diamine (N-coco-1,3 diaminopropane), N-oleyl-1,3-propylene diamine (N-oleyl-1,3 diaminopropane), N-tallow-1,3-propylene diamine (N-tallow-1,3 diaminopropane), and mixtures thereof. Such N-alkyl-1,3 diaminopropanes are available from Akzo Chemie America, Armak Chemicals under the trademark Duomeen ®.

Fatty Acids

A wide variety of fatty acids may be usefully employed in the lubricant compositions of the invention. Those acids found to provide effective lubricity are those having the general formula $R^6COOH$ wherein $R^6$ represents an aliphatic group having from about 9 to about 17 carbon atoms so as to produce a fatty acid having about 10 to 18 carbon atoms. For use in formulating the solid form of the composition the $C_{10-18}$ fatty acids are preferred as they assist in solidification of the composition. The aliphatic group may be branched or unbranched and saturated or unsaturated but is preferably a straight chain alkyl group.

Specific examples of suitable fatty acids include such saturated fatty acids as capric (decanoic) ($C_{10}$), undecyclic (undecanoic) ($C_{11}$), lauric (dodecanoic) ($C_{12}$), trideclic (tridecanoic) ($C_{13}$), myristic (tetradecanoic) ($C_{14}$), palmitic (hexadecanoic) ($C_{16}$), stearic (octadecanoic) ($C_{18}$); monounsaturated fatty acids such as lauroleic ($C_{12}$), myristoleic ($C_{14}$), palmitoleic ($C_{16}$), and oleic ($C_{18}$); polyunsaturated fatty acids such as linoleic (di-unsaturated $C_{18}$), and linolenic (tri-unsaturated $C_{18}$); and substituted fatty acids such as ricinoleic (hydroxy-substituted $C_{18}$).

Mixed fatty acids may be employed in the lubricant composition of the invention such as those derived from fats and oils. Coconut oil fatty acids are particularly preferred in the lubricant compositions of the invention because of their ready availability and superior lubricating properties. Coconut oil fatty acids include major fractions of lauric and myristic acids and minor fractions of palmitic, stearic, oleic and linoleic acids. Tall oil fatty acids, obtained as a byproduct of the paper industry from the tall oil recovered from pine wood black liquor, are also preferred fatty acids for use in the lubricant composition of the invention. Tall oil fatty acids include major fractions of oleic and linoleic acids and minor fractions of palmitic, stearic, and isostearic acids.

Other Components

Water

When the lubricant composition of the invention is formulated as a liquid the composition includes a major portion of water in addition to the fatty acid diamine salt.

Solidifying Agent

When the lubricant composition of the invention is formulated as a solid the composition optionally, but preferably, includes an effective solidifying proportion of a solidifying agent. Any compound which is compatible with the other components of the lubricant composition and is capable of aiding in solidification of the composition may be employed. Suitable solidification agents include higher molecular weight glycols, polyalkylene glycols such as polyethylene glycol (PEG), higher molecular weight fatty acid soaps, and urea. The fatty acid soaps may be conveniently formed in situ by adding sodium or potassium hydroxide to the composition so as to convert a portion of the fatty acid to the corresponding alkali metal fatty acid soap (See Trial #s 11 and 12).

Hydrotrope

The lubricant composition of the invention includes an effective amount of a hydrotrope for effecting aqueous solubilization of the fatty acid and the diamine. Such mutual aqueous solubilization is necessary for achieving substantially complete neutralization of the fatty acid by the diamine and for phase stability of the dilute use solution of the lubricant composition. A variety of compatible hydrotropes are available for use in the lubricant composition. For reasons of overall compatibility with the other components and effectiveness for solubilizing the fatty acid and diamine, the preferred hydrotropes are the anionic surfactant sulfonates. A non-exhaustive list of suitable sulfonates includes specifically, but not exclusively, alkali metal salts of $C_{6-18}$ alkyl sulfonates such as sodium decane sulfonate and sodium dodecane sulfonate, alkali metal aryl sulfonates such as sodium benzene sulfonate and sodium phenol sulfonate, and $C_{6-30}$ alkaryl sulfonates such as sodium $C_{2-18}$ alkyl naphthalene sulfonate and sodium xylene sulfonate.

Hydrotropes which are solid under ambient conditions may be usefully employed when formulating the solid form of the lubricant compositions of the invention as such solid hydrotropes assist in solidification of the composition. Suitable solid hydrotropes for use in the lubricant compositions of the invention includes specifically, but not exclusively, $C_{2-18}$ alkyl naphthalene sulfonates available from PetroChemicals Company, Inc. under the mark "Petro".

The proportion of hydrotrope which should be employed depends upon various factors including the specific hydrotrope employed and the specific fatty acid and diamine employed. However, effective results can generally be obtained by including about 2–40 wt % hydrotrope, preferably about 5–20 wt %, in the lubricant composition.

Surfactants

The lubricant compositions of the invention optionally, but preferably, may further include a compatible material for enhancing the lubricity of the composition, such as an anionic or nonionic surfactant.

Anionic surfactants are generally those compounds containing a hydrophobic hydrocarbon moiety and a negatively charged hydrophilic moiety. Typical commercially available products provide either a carboxylate, sulfonate, sulfate or phosphate group as the negatively charged hydrophilic moiety. Broadly, any of the commercially available anionic surfactants may be usefully employed in the lubricant composition of the invention.

Particularly suitable anionic surfactants for use in the lubricant composition of the invention are the sulfonates having the general formula $(R^{30})SO_3Na$ wherein $R^{30}$ is a hydrocarbon group in the surfactant molecular-weight range. For reasons of cost, availability and overall compatibility with the other components of the lubricant composition, the preferred anionic surfactants for use in the lubricant composition are the alkaryl sulfonates such as alkyl benzene sulfonates and alkyl naphthalene sulfonates.

Nonionic surfactants are generally hydrophobic compounds which bear essentially no charge and exhibit a hydrophilic tendency due to the presence of oxygen in the molecule. Nonionic surfactants encompass a wide variety of polymeric compounds which include specifically, but not exclusively, ethoxylated alkylphenols, ethoxylated aliphatic alcohols, ethoxylated amines, carboxylic esters, carboxylic amides, and polyoxyalkylene oxide block copolymers.

Particularly suitable nonionic surfactants for use in the lubricant composition of the invention are the alkoxylated (preferably ethoxylated) alcohols having the general formula $R^{10}O((CH_2)_mO)_n$ wherein $R^{10}$ is an aliphatic group having from about 8 to about 24 carbon atoms, m is a whole number from 1 to about 5, and n is a number from 1 to about 20 which represents the average number of ethyleneoxide groups on the molecule.

Based upon their overall compatibility with the other components of the lubricant composition and their ability to enhance the lubricity and cleansing effect of the lubricant composition at a reasonable cost, a particularly preferred group of nonionic surfactants are the alkoxylated amines having the general formula $(R^{21})(R^{22})(R^{23})N$ wherein $R^{21}$, $R^{22}$, and $R^{23}$ are independently hydrogen, a $C_{1-5}$ alkyl, or a polyalkoxy (preferably polyethoxy) group having the general formula $((CH_2)_mO)_n$ wherein m is a number from 2 to 4 and n is a number from 1 to about 20 with at least one of $R^{21}$, $R^{22}$, and $R^{23}$ being a polyalkoxy group.

Sequestrant

The compositions of the invention may also optionally contain a sequestrant for the purpose of complexing or chelating hardness components in the service water into which the lubricant composition is dispensed. Sequestrants are reagents that combine with metal ions to produce soluble complexes or chelate compounds. The most common and widely used sequestrants are those that coordinate metal ions through oxygen and/or nitrogen donor atoms. The sequestrant use in the lubricant composition of the invention may be organic or inorganic so long as it is compatible with the other components of the composition. Based upon availability and overall compatibility with the other components, the preferred sequestrant is ethylenediamine tetraacetic acid.

Alcohol

The novel lubricant compositions of the invention may also contain a $(C_{1-10})$ alcohol having about 1-5 hydroxy groups for the purpose of enhancing the physical stability, wettability, and activity of the composition. A nonexhaustive list of suitable alcohols include methanol, ethanol, isopropanol, t-butanol, ethylene glycol, propylene glycol, hexylene glycol, glycerine, low molecular weight polyethylene glycol compounds, and the like.

Other Components

In addition to the above mentioned components, the lubricating compositions of the invention may also contain those components conventionally employed in conveyor lubricant compositions, which are compatible in the composition, to achieve specified characteristics such as anti-foam additives, viscosity control agents, perfumes, dyes, corrosion protection agents, etc.

Concentrations

Broadly, the solid and liquid forms of the concentrated lubricant compositions of the invention should include about 1-70 wt % of the fatty acid diamine salt. More specifically, the liquid form should include about 1-50 wt % fatty acid diamine salt and the solid concentrate about 5-70 wt % fatty acid diamine salt.

A preferred liquid concentrate of the lubricant composition of the invention includes about 5-25 wt % fatty acid diamine salt made from about 4-20 wt % fatty acid and 1-10 wt % diamine. The liquid concentrate can also include about 2-40 wt % hydrotrope, about 2-30 wt % surfactant, and about 1-20 wt % sequestrant.

A preferred solid concentrate of the lubricant composition of the invention includes about 10-60 wt % fatty acid diamine salt made from about 8-50 wt % fatty acid and about 2-20 wt % diamine. The solid concentrate can also include about 2-40 wt % hydrotrope, about 2-30 wt % surfactant, and about 1-20 wt % sequestrant.

The lubricant compositions of the invention may be applied to the load bearing surface of a conveyor system by any of the recognized methods for such application including the most commonly utilized and widely accepted practice of spraying the lubricant onto the moving conveyor surface. However, prior dispensing the lubricant compositions of the invention onto the moving conveyor, the composition must be diluted with water to use strength. The diluted lubricant use solution should contain about 50 to 20,000 ppm (wt/v), preferably about 100 to 10,000 ppm (wt/v), active lubricant components wherein the active components of the lubricant composition includes all those components which contribute to the lubricating efficacy of the composition, specifically excluding any water contained in the composition. More specifically, the diluted lubricant use solution should contain about 50 to 10,000 ppm (wt/v), preferably about 100 to 5,000 ppm (wt/v) fatty acid diamine salt, about 50 to 8,000 ppm (wt/v) hydrotrope, about 0 to 6,000 ppm (wt/v) surfactant, and about 0 to 5,000 ppm (wt/v) sequestrant.

This description is provided to aid in a complete nonlimiting understanding of the invention. Since many variations of the invention may be made without departing from the spirit and scope of the invention, the breadth of the invention resides in the claims hereinafter appended.

TABLE ONE

| | Liquid Formulations (wt %) | | | | | | | | | | | | | |
|---|---|---|---|---|---|---|---|---|---|---|---|---|---|---|
| | Amines | | | | | Fatty Acids | | | Sulfonates | | | | | |
| # | DuoCD | $C_{12}$PA | K202 | K210 | K215 | Oleic | Coco | Tall | Petro | NOS | SXS | V100 | Neo | Water |
| 1 | — | 5.9 | — | — | — | 6.0 | 6.0 | — | 40.0 | — | — | 10.0 | — | 32.1 |
| 2 | — | — | 9.0 | — | — | 6.0 | 6.0 | — | 40.0 | — | — | 10.0 | — | 29.0 |
| 3 | 4.0 | — | — | — | — | 6.0 | 6.0 | — | 40.0 | — | — | 10.0 | — | 34.0 |
| 4 | 4.0 | — | — | — | — | 6.0 | 6.0 | — | 50.0 | — | — | 10.0 | — | 24.0 |
| 5 | 4.0 | — | — | — | — | 6.0 | 6.0 | — | 50.0 | — | — | 10.0 | 2.0 | 22.0 |
| 6 | 3.2 | — | — | 5.0 | — | 5.0 | 5.0 | — | 40.0 | — | — | 10.0 | — | 31.8 |
| 7 | 2.5 | — | — | 5.0 | — | 5.0 | 5.0 | — | 40.0 | — | — | 10.0 | — | 32.5 |
| 8 | 1.5 | — | — | — | 15.0 | — | — | 12.0 | — | 40.0 | — | 10.0 | — | 21.5 |
| 9 | 1.5 | — | — | — | 15.0 | — | — | 12.0 | — | — | 40.0 | 10.0 | — | 21.5 |

TABLE TWO

| | Solid Formulations (wt %) | | | | | | | | | | | | | | |
|---|---|---|---|---|---|---|---|---|---|---|---|---|---|---|---|
| | Amines | | | | | Fatty Acids | | | Sulfonates | | | | | | |
| # | DuoCD | T-20 | K215 | Oleic | Coco | Tall | NaOH | Petro | NOS | SXS | V100 | X3176 | DF210 | Urea | PEG |
| 10 | 4.0 | — | — | 5.0 | 5.0 | — | — | 40.0 | 26.0 | — | 10.0 | 10.0 | — | — | — |
| 11 | 3.0 | — | 21.9 | — | — | 23.8 | 6.8 | 39.6 | — | — | 4.0[a] | — | 1.0 | — | — |
| 12 | 3.0 | — | 24.0 | — | 10.0 | 14.0 | 4.0 | 40.0 | — | — | 4.0[a] | — | 1.0 | — | — |
| 13 | 5.0 | — | 10.0 | 10.0 | 10.0 | — | — | 40.0[b] | — | — | 4.0 | — | — | 15.0 | — |
| 14 | 3.0 | — | 19.0 | — | — | 20.0 | — | 38.0[c] | — | — | 4.0 | — | 1.0 | 15.0 | — |
| 15 | — | 27.7 | — | — | — | 19.8 | — | 29.7[d] | — | — | 4.0 | — | 1.0 | — | 17.8 |
| 16 | — | 28.0 | — | — | — | 20.0 | — | — | — | 20.0[a] | 3.0 | — | 1.0 | — | 28.0 |

[a]Versene 220 ® used in place of Versene 100 ®.
[b]Added as 16 wt % LBA liquid and 30 wt % BA powder.
[c]Added as 8 wt % LBA liquid and 30 wt % BA powder.
[d]Added as BA powder.
[e]Added as a 90 wt % active powder.

TABLE THREE

| Formulation Comments | |
|---|---|
| Formula # | Comments |
| 1 | Liquid concentrate contained curds. Incorporation of additional Petro LBA ® reduced amount of curdling but did not completely eliminate. A 1 wt % use solution of the composition had a pH of 8.86. |
| 2 | Liquid concentrate. A 1 wt % use solution of the composition had a pH of 8.68 and was slightly hazy. |
| 3 | Liquid concentrate. A 1 wt % use solution of the composition had a pH of 8.98 and was slightly hazy. |
| 4 | Liquid concentrate. |
| 5 | Liquid concentrate. A 1 wt % use solution of the composition had a pH of 8.85. |
| 6 | Liquid concentrate. A 1 wt % use solution of the composition had a pH of 9.40. |
| 7 | Liquid concentrate. A 1 wt % use solution of the composition had a pH of 9.08. |
| 8 | Liquid concentrate. The concentrated composition was clear. A 1 wt % use solution of the composition had a pH of 7.84. |
| 9 | The liquid concentrate was clear and remained stable at 40° F. A 1 wt % use solution of the composition had a pH of 8.94. |
| 10 | Solid concentrate. A 1 wt % use solution of the composition had a pH of 8.13 and was |

TABLE THREE-continued

| Formulation Comments | |
|---|---|
| Formula # | Comments |
| | clear. |
| 11 | The concentrate was solid but slightly tacky. A 0.5 wt % use solution of the composition had a pH of 10.99. |
| 12 | The mixture was fluid at 190–200° F. and solidified quickly upon cooling. The concentrate was solid but slightly tacky. The solid concentrate was easily removed from the mold. A 0.5 wt % use solution of the composition had a pH of 9.86. |
| 13 | The mixture gelled during mixing but thinned when heated slightly. The concentrate was solid but tacky. The solid concentrate would not release from the mold. |
| 14 | Solid concentrate. A use solution of the composition was turbid. |
| 15 | The solid concentrate was a soft, slightly tacky composition. A 0.5 wt % use solution of the composition was clear. A 0.5 wt % use solution of the composition had a pH of 8.68. |
| 16 | The concentrate was a soft solid. A use solution of the composition was opaque. |

Polyethylene Terephthalate Bottle Stress Crack Testing Procedure

The test is designed to comparatively determine the affect of conveyor lubricating compositions on pressurized polyethylene terephthalate (PET) bottles.

Fill twenty-four two liter polyethylene terephthalate test bottles with carbonated city water, using a McCann carbonator equipped with a Procon pump, to 5.0 to 5.2 volumes of $CO_2$ as determined by a Zahm-Nagel $CO_2$ Tester. Test every sixth bottle during filling for $CO_2$ loading. If the tested bottle is below 5.0 volumes $CO_2$ discard tested and previous five bottles. Allow the filled bottles to set at room temperature overnight.

Dilute the two concentrated conveyor lubricant compositions to be tested with distilled water at a lubricant:water ratio of 1:60 (1.67%) for the liquid concentrated lubricants and 1:200 (0.50%) for the solid concentrated lubricants.

Separately place 200 mls of each of the dilute lubricant solutions into a mixing bowl and whip with a Kitchen Aid K-5A Mixer equipped with a wire whip attachment at a speed setting of ten for five minutes in order to foam the solution.

Separately rinse a 13.5" by 18.5" (inside diameter) polyethylene storage bin with 100 mls of the dilute lubricant solutions (unfoamed). Drain the rinsed bins

| Nomenclature* | |
|---|---|
| DuoCD = | Duomeen CD ® (N-coco-1,3-[propane] diamine) available from Akzo Chemie America, Armak Chemicals. |
| $C_{12}PA$ = | A dodecyl amine available from Akzo Chemie America, Armak Chemicals. |
| K202 = | Varonic K202 ® (a $C_{10-18}$ alkyl amine ethoxylate having an average of about 2 moles of ethyleneoxide per molecule available from Sherex Chemical Co. Inc. |
| K210 = | Varonic K210 ® (a $C_{10-18}$ alkyl amine ethoxylates) having an average of about 10 moles of ethyleneoxide per molecule available from Sherex Chemical Co. Inc. |
| K215 = | Varonic K210 ® ($C_{10-18}$ alkyl amine ethoxylates) having an average of about 15 moles of ethyleneoxide per molecule available from Sherex Chemical Co. Inc. |
| Oleic = | Oleic oil fatty acids. A mixture of $C_{10-18}$ fatty acids containing primarily $C_{18}$ fatty acids. |
| Coco = | Coconut oil fatty acids. A mixture of $C_{12-18}$ saturated and unsaturated fatty acids containing primarily $C_{12}$ and $C_{14}$ saturated fatty acids. |
| Tall = | Tall oil fatty acids. A mixture of $C_{16-18}$ saturated and unsaturated fatty acids containing primarily monounsaturated and diunsaturated $C_{18}$ fatty acids. |
| Petro = | Petro LBA ® ($C_{2-18}$ alkyl naphthalene sulphonates) available from PetroChemical Co. Inc. Petro BA ® is a dark colored form of Petro LBA ®. |
| NOS = | n-octyl sulphonate. |
| SXS = | Aqueous solution of 40 wt % sodium xylene sulphonate. |
| V100 = | Versene 100 ® (aqueous solution containing 40 wt % tetrasodium EDTA) available from Dow Chemical Company. |
| V220 = | Versene 220 ® (powdered tetrasodium EDTA) available from Dow Chemical Company. |
| Neo = | Neodol ® ($C_{14-15}$ alcohol ethoxylates having an average of 12 to 14 moles ethyleneoxide per molecule) available from Shell. |
| X3176 = | Desomeen X-3176 ® (proprietary cationic surfactants) available from Desoto Chemical Company. |
| DF210 = | Mazu DF210 ® (a silicone defoamer containing 10% active components) available from Mazer Chemical. |
| T-20 = | Ethoduomeen T/20 ® (an ethoxylated N-tallow-1,3-diaminopropane containing an average of 10 ethoxy units) available from Akzo Chemie America, Armak Chemicals. |
| PEG = | Polyethylene glycol having an average molecular weight of about 8000 available from Union Carbide Corp. |

*All are 100% active unless otherwise specified.

thoroughly and place 75.0 grams of each of the foamed lubricant solutions into separate storage bins.

Place twelve of the filled bottles into each of the polyethylene bins making sure all bottle bottoms are thoroughly coated with the foamed lubricant solution. Allow the filled bottles to set for four to five hours under room conditions.

Set the filled bottles while still in the polyethylene bins in a temperature/humidity control room set at a temperature of 100° F. +/−5° F. and a humidity of 85% Relative Humidity +/−5%. Monitor the bottles daily for any leakage for fourteen days. After completion of testing period, compare crack formation on bottles treated with the two different lubricant compositions.

Polyethylene Terephthalate Compatability Testing

Polyethylene terephthalate compatability testing was conducted for Formulations #4, #5, #7 and #10 in accordance with the "Bottle Stress Crack Testing Procedure" set forth above. In addition, commercially available conveyor lubricants employing ethoxylated amines (DicoLube PL TM) and alkyl dimethyl amines as described in U.S. Pat. No. 4,929,375 as the active lubricant were tested for polyethylene terephthalate compatability. All formulations and commercially available products resulted in zero leakage. However, based upon comparison testing of crack formation, the polyethylene terephthalate compatability of those lubricants based upon the diamines (The Invention) were observed to be superior to those based upon ethoxylated amines (DicoLube PL TM) and those based upon alkyl dimethyl amines as described in U.S. Pat. No. 4,929,375.

We claim:

1. An aqueous liquid conveyor lubricant concentrate which is compatible with synthetic polymeric packaging materials, the concentrate comprising:

(a) a balance of water;

(b) about 2–40 wt-% of a hydrotrope; and (c) about 1–70 wt-% of a fatty acid diamine salt comprising, (i) a diamine of the formula $((R^1)(R^2)N(R^5)NH(R^3)(R^5))^+$. or $((R^1)(R^2)NH(R^5)NH(R^3)(R^4))^{++}$; and (ii) at least one fatty acid of the formula $(R^6COO)^-$;

wherein $R^1$ is a $C_{10-18}$ aliphatic group; $R^2$, $R^3$, and $R^4$ are independently hydrogen or an alkoxy group containing one to five alkylene oxide units; $R^5$ is a $C_{1-5}$ alkylene group; and $R^6$ is a $C_{10-18}$ aliphatic group wherein said fatty acid diamine salt is formed spontaneously by adding said hydrotrope to said water and then adding said fatty acid and said diamine to said water and hydrotrope.

2. The aqueous liquid conveyor lubricant concentrate of claim 1 comprising about 2–30 wt-% of an anionic or nonaionic surfactant.

3. The concentrate of claim 2 wherein the surfactant is selected from the group consisting of fatty acid soaps, sulfonates, alkoxylated aliphatic alcohols, alkoxylated amines, and mixtures thereof.

4. The aqueous liquid conveyor lubricant concentrate of claim 1 comprising about 1–20 wt-% of a chelating agent.

5. The concentrate of claim 4 wherein the chelating agent is ethylene diamine tetraacetic acid or a salt thereof.

6. The concentrate of claim 1 wherein $R^1$ is derived from a $C_{10-18}$ fatty acid.

7. The concentrate of claim 1 wherein $R^5$ is a propylene group.

8. The concentrate of claim 1 wherein the diamine portion of the diamine fatty acid salt is a N-($C_{10-18}$) aliphatic-1,3-propylene diamine.

9. The concentrate of claim 1 wherein the hydrotrope is an alkali metal sulphonate selected from the group consisting of alkali metal $C_{6-18}$ alkyl sulfonates and alkali metal $C_{6-30}$ alkaryl sulfonates.

10. The concentrate of claim 1 wherein the lubricant comprises about 1–50 wt % fatty acid diamine salt.

11. A process for lubricating the load bearing surface of a conveyor system comprising the step of coating the load bearing surface of the conveyor system with a sufficient lubricating amount of a conveyor lubricant comprising at least (a) a major proportion of water, and (b) about 50 to 10,000 ppm (w/v) of a fatty acid diamine salt comprising (i) a diamine of the formula $((R^1)(R^2)NR^5NH(R^3)(R^4))^+$, or $((R^1)R^2)NH(R^5)NH(R^3)(R^4))^{++}$; and (ii) at least one fatty acid of the formula $(R^6COO)^-$; wherein $R^1$ is a $C_{10-18}$ aliphatic group; $R^2$, $R^3$, and $R^4$ are independently hydrogen or an alkoxy group containing one to five alkylene oxide units; $R^5$ is a $C_{1-5}$ alkylene group; and $R^6$ is a $C_{10-18}$ aliphatic group.

12. The process of claim 11 wherein $R^1$ is derived from a $C_{10-18}$ fatty acid and $R^5$ is a propylene group.

13. The process of claim 11 wherein said fatty acid diamine salt comprises a $C_{10-18}$ fatty acid and a diamine having the formula $(R^1)(R^2)N(R^5)NH(R^3)(R^4)$ wherein $R^1$ is a $C_{10-18}$ aliphatic group; $R^2$, $R^3$, and $R^4$ are independently hydrogen or an alkoxy group containing one to five alkylene oxide units; and $R^5$ is a $C_{1-5}$ alkylene group.

14. A process for lubricating the load bearing surface of a conveyor system comprising the steps of:

(a) dispersing a concentrate of a lubricating composition into sufficient water to form an aqueous lubricating solution of about 50–10,000 ppm (w/v) fatty acid diamine salt, wherein said lubricating concentrate comprises a fatty acid diamine salt comprising, (i) a diamine of the formula $((R^1)(R^2)N(R^5)NH(R^3)(R^4))^+$, or $((R^1)(R^2)NH(R^5)NH(R^3)(R^4))^{++}$;

and at least one fatty acid of the formula $(R^6COO)^-$, wherein $R^1$ is a $C_{10-18}$ aliphatic group; $R^2$, $r^3$, and $R^4$ are independently hydrogen or an alkoxy group containing one to five alkylene oxide units; $R^5$ is a $C_{1-5}$ alkylene group; and $R^6$ is a $C_{10-18}$ aliphatic group; and (b) placing said lubricating solution onto the load bearing surface of an operating conveyor system in an amount and for a period of time effective to lubricate the load bearing surface.

15. The process of claim 14 wherein the lubricating solution comprises at least about 100–5,000 ppm (w/v) of the fatty acid diamine salt.

16. The process of claim 14 wherein $R^1$ is derived from a $C_{10-18}$ fatty acid and $R^5$ is a propylene group.

17. The process of claim 14, wherein said lubricating solution comprises at least about 50–5000 ppm (w/v) of a $C_{10-18}$ fatty acid and a diamine having the formula $$(R^1)(R^2)N(R^5)NH(R^3)(R^4)$$

wherein $R^1$ is a $C_{10-18}$ aliphatic group; $R^2$, $R^3$, and $R^4$ are independently hydrogen or an alkoxy group containing one to five alkylene oxide units; and $R^5$ is a $C_{1-5}$ alkylene group.

18. A solid conveyor lubricant concentrate dilutable with an aqueous base to form a use solution which is compatible with synthetic polymeric packaging materials, the concentrate comprising:

(a) about 5–70 wt-% of a fatty acid diamine salt comprising, (i) a diamine of the formula $$((R^1)(R^2)N(R^5)NH(R^3)(R^4)^{+}, \text{ or}$$

$$((R^1)(R^2)NH(R^5)NH(R^3)(R^4)^{++}; \text{ and}$$

(ii) at least one fatty acid of the formula $(R^6COO)^-$;

wherein $R^1$ is a $C_{10-18}$ aliphatic group; $R^2$, $R^3$, and $R^4$ are independently hydrogen or an alkoxy group containing one to five alkylene oxide units; $R^5$ is a $C_{1-5}$ alkylene group; and $R^6$ is a $C_{10-18}$ aliphatic group; and (b) an amount of a solidification agent effective for solidifying the concentrated lubricant.

19. The concentrated solid conveyor lubricant of claim 18 further comprising (c) an effective cleansing amount of an anionic or nonionic surfactant, and (d) an effective chelating amount of a chelating agent.

20. The concentrated solid conveyor lubricant of claim 19 wherein the chelating agent is ethylene diamine tetraacetic acid.

21. The concentrated solid conveyor lubricant of claim 18 wherein $R^1$ is derived from a $C_{10-18}$ fatty acid and $R^5$ is a propylene group.

22. The concentrated solid conveyor lubricant of claim 18 wherein the diamine portion of the diamine fatty acid salt is a N-($C_{10-18}$) aliphatic-1,3-propylene diamine.

23. The concentrated solid conveyor lubricant of claim 18 wherein the lubricant comprises about 5–70 wt % of the fatty acid diamine salt.

24. The concentrated solid polyethylene terephthalate compatible conveyor lubricant of claim 18, wherein said fatty acid diamine salt comprises a $C_{10-18}$ fatty acid and a diamine salt has having the formula $(R^1)(R^2)N(R^5)NH(R^3)(R^4)$ wherein $R^1$ is a $C_{10-18}$ aliphatic group; $R^2$, $R^3$, and $R^4$ are independently hydrogen or an alkoxy group containing one to five alkylene oxide units; and $R^5$ is a $C_{1-5}$ alkylene group.

25. The solid concentrated conveyor lubricant of claim 24 further comprising (c) an effective cleansing amount of an anionic or nonionic surfactant, and (d) an effective chelating amount of a chelating agent.

26. The solid concentrated conveyor lubricant of claim 24 wherein $R^1$ is derived from a $C_{10-18}$ fatty acid and $R^5$ is a propylene group.

* * * * *